United States Patent [19]

Vydrzal

[11] Patent Number: 5,031,838

[45] Date of Patent: Jul. 16, 1991

[54] SPRINKLER BASE

[75] Inventor: Billy Vydrzal, Smithville, Tex.

[73] Assignees: Nancy D. Vydrzal; William S. Vydrzal; Tracy L. Vydrzal; Douglas J. Vydrzal, Smithville, Tex.

[21] Appl. No.: 550,527

[22] Filed: Jul. 10, 1990

[51] Int. Cl.[5] ..... B05B 15/06

[52] U.S. Cl. ..... 239/280; 239/273; 239/198; 248/83; 248/90

[58] Field of Search ..... 239/273, 275, 279, 280, 239/195, 198; 248/75, 76, 79, 80, 83, 89, 90

[56] References Cited

U.S. PATENT DOCUMENTS

| | | | |
|---|---|---|---|
| 210,402 | 12/1878 | Cain | 248/90 |
| D. 255,378 | 6/1980 | Tropeano | D23/7 |
| 622,132 | 3/1899 | Dungan | 248/76 |
| 671,485 | 4/1901 | Johnston | 239/273 |
| 769,278 | 9/1904 | Secord | 239/273 |
| 1,651,511 | 12/1927 | Cheney | 239/279 |
| 2,464,366 | 3/1949 | Bakke | 248/80 |
| 2,694,600 | 11/1954 | Richey | 248/83 |
| 2,731,296 | 1/1956 | Griffith | 239/279 |
| 3,329,381 | 7/1967 | Moore et al. | 248/89 |

FOREIGN PATENT DOCUMENTS

| | | | |
|---|---|---|---|
| 2105615 | 3/1983 | United Kingdom | 239/279 |

*Primary Examiner*—Andres Kashnikow
*Assistant Examiner*—Karen B. Merritt
*Attorney, Agent, or Firm*—Walter C. Farley

[57] ABSTRACT

A lawn sprinkler base has a flat base plate with three radial arms extending from a central portion. An elbow conduit is mounted on the central portion and has threads for connection to a garden hose at one end and to a sprinkler at the top. Hooks are the distal ends of the arms point inwardly toward the center so that a garden hose can be connected to a conduit and then coiled around on the base plate, inserting the hose under each hook as it is reached. The base stabilizes the sprinkler and base against the reaction effects of water pressure and the like.

13 Claims, 3 Drawing Sheets

SPRINKLER BASE

This invention relates to a lawn sprinkling device and, more particularly, to a base for a lawn sprinkler which employs the weight of a garden hose to which it is connected in order to stabilize the sprinkler.

BACKGROUND OF THE INVENTION

Lawn sprinklers generally are constructed with some sort of base, a sprinkler head which dispenses water in a desired pattern and one or more conduits through the structure to deliver water to the sprinkler head. The sprinkler is generally designed with a fitting or attachment to a standard garden hose and may be provided with one or more of a wide variety of dispensing heads, some of which are fixed and have numerous openings through which the water can pass and others of which have either rotating or oscillating water dispensers.

In addition to the nature of the sprinkler head, there are two factors which must be taken into consideration when developing a sprinkler. One of those factors is the stability of the structure and the other is its ability to be manually moved across the lawn. For stability, most sprinklers are designed with relatively large bases compared with their height or with legs which are spread apart to provide maximum mechanical stability. Still others are designed with pointed members to pierce the ground, keeping the sprinkler in one place until it is manually extracted.

As to movement, it is desirable under some circumstances to be able to grasp the garden hose at some distance from the sprinkler and simply pull, sliding the sprinkler across the grass to move it from a location which has been adequately watered to a new location. Clearly, the sprinklers which are designed to penetrate the ground cannot be moved in this fashion, requiring that the water be turned off, the sprinkler moved and the water turned on again.

While many sprinklers seem to serve their purposes well, new designs are continually being developed in an effort to improve the sprinklers and also to reduce manufacturing cost and complexity.

SUMMARY OF THE INVENTION

An object of the present invention is to provide an improved sprinkler base structure which can be used with a variety of different types of sprinkler heads and which utilizes the weight of the garden hose to improve the stability of the sprinkler.

A further object is to provide such a sprinkler base which is simple and economical to produce and is sturdy and reliable.

Briefly described, the invention comprises a base for a sprinkler head having a water conduit with a first end connectible to the sprinkler head and a second end connectible to a garden hose. A substantially planar base plate has a central portion with means for supporting the water conduit and a plurality of arm portions extending radially outwardly from the central portion, each of the arm portions having a distal end. A plurality of hook members are mounted on the distal ends of the arm portions, each hook member defining an inwardly facing cavity dimensioned to receive a portion of a garden hose. In use, a hose is coiled around the central portion with portions of the hose being successively inserted into the cavities of the hook members. The end of the hose is then attached to the second end of the conduit to supply water through the conduit to the sprinkler head while the weight of the hose stabilizes the base.

BRIEF DESCRIPTION OF THE DRAWINGS

In order to impart full understanding of the manner in which the foregoing and other objects are attained in accordance with the invention, a particularly advantageous embodiment thereof will be described with reference to the accompanying drawings, which form a part of this specification, and wherein.

DESCRIPTION OF THE PREFERRED EMBODIMENTS

Figure 3:
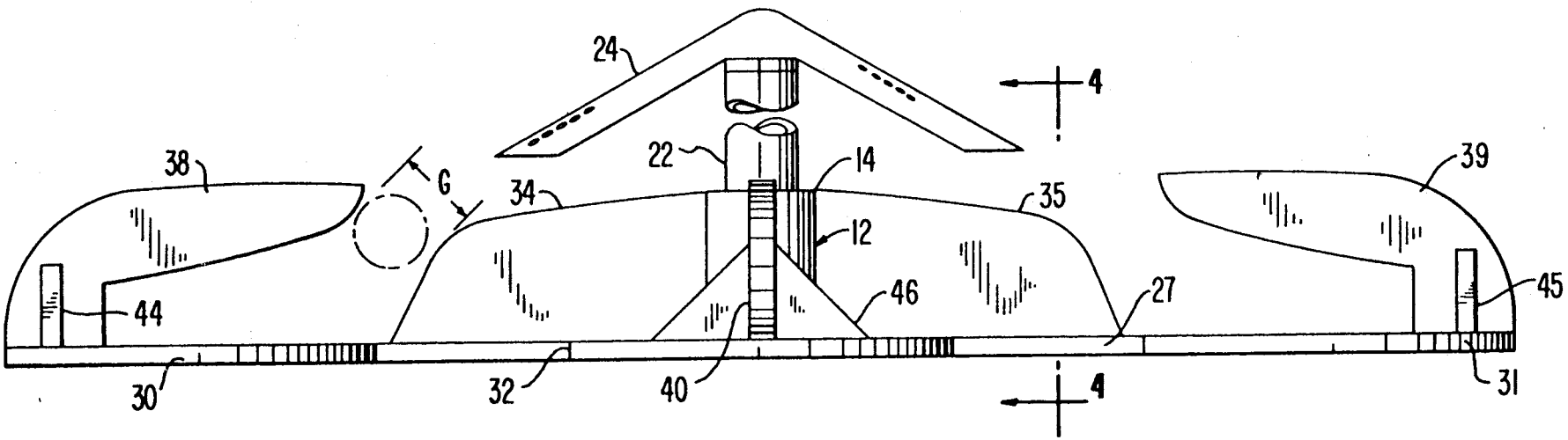
FIG. 3 is a side elevation of the sprinkler base of FIGS. 1 and 2.

As shown in the figures, the sprinkler in accordance with the invention includes a base plate indicated generally at 10 which supports an elbow water conduit 12 which is L-shaped and has a first, upper end 14 and a second, laterally extending end 16. End 16 is provided with a conventional, internally threaded fitting 17 to receive the externally threaded male end 18 of a garden hose 20. The upwardly opening end 14 is also internally threaded for the purpose of receiving the externally threaded end of a pipe 22 which leads to, or can be part of, a sprinkler head 24. As previously indicated, a variety of different types of sprinkler heads can be used and the nature of the sprinkler head itself is not part of the present invention. FIG. 3 illustrates a type which has radially and downwardly extending arms and is rotatable about the top of pipe 22, the arms being perforated along their upper surfaces to dispense water in a generally circular pattern as it rotates, the rotation itself being powered by the pressure of the water supplied to the head in a well-known fashion.

As will be apparent, water under pressure is supplied through hose 20 and conduit 12 to the sprinkler head.

Base plate 10 includes a central portion 13 and three arms 26, 27, and 28 which extend radially outwardly from that central portion. Arms 26 and 27 are substantially aligned with each other on opposite sides of the central portion while arm 28 extends perpendicular to the other two arms to form a T-shaped plate member. At the ends of arms 26–28 are circular enlargements 30, 31, and 32 which contribute to the surface area of the plate and thus its stability and also which eliminate sharp outer corners which could catch on grass.

Three brace members 34, 35 and 36 lie in planes which are perpendicular to the plane containing the base plate, the braces being separated by at least 90° and being attached to conduit 12 and also to the upper surface of the base plate to form a support system for the conduit. The upper edges of braces 34–36 are curved to form passageways for the garden hose, as will be described.

Figure 4:
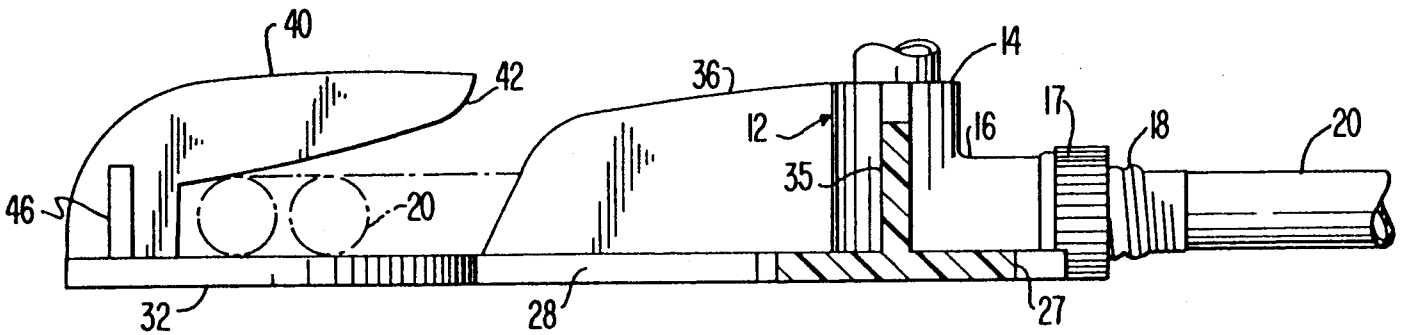
FIG. 4 is an end elevation, in partial section along line 4—4 of FIG. 3.

At the ends of arms 26–28 are hook members 38, 39 and 40, each hook member being generally L-shaped and having one end fixedly attached to the upper surface of plate 10. The other end of each hook member, as best seen in FIGS. 3 and 4, tapers to a point, the lower or inner surface of the hook member being curved as seen at 42. Curvature 42 of each hook member forms, with its associated brace 34–36, a gap G which is sufficiently wide to permit sideways entry of a portion of garden hose into the inwardly facing cavity under the hook but is narrow enough to inhibit inadvertent exit of the hose from the cavity.

Figure 1:
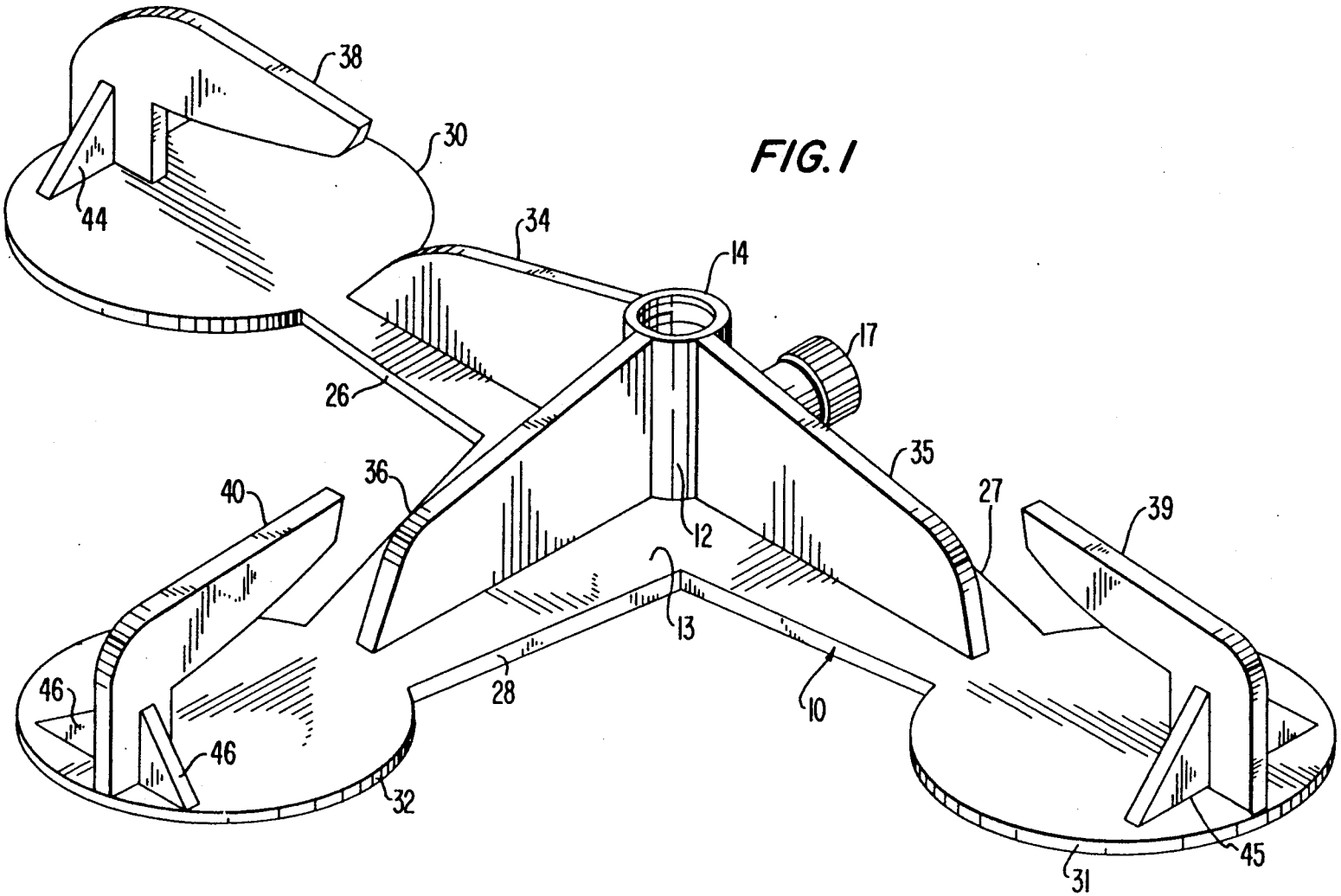
FIG. 1 is a perspective view of a sprinkler base in accordance with the present invention.
Figure 2:
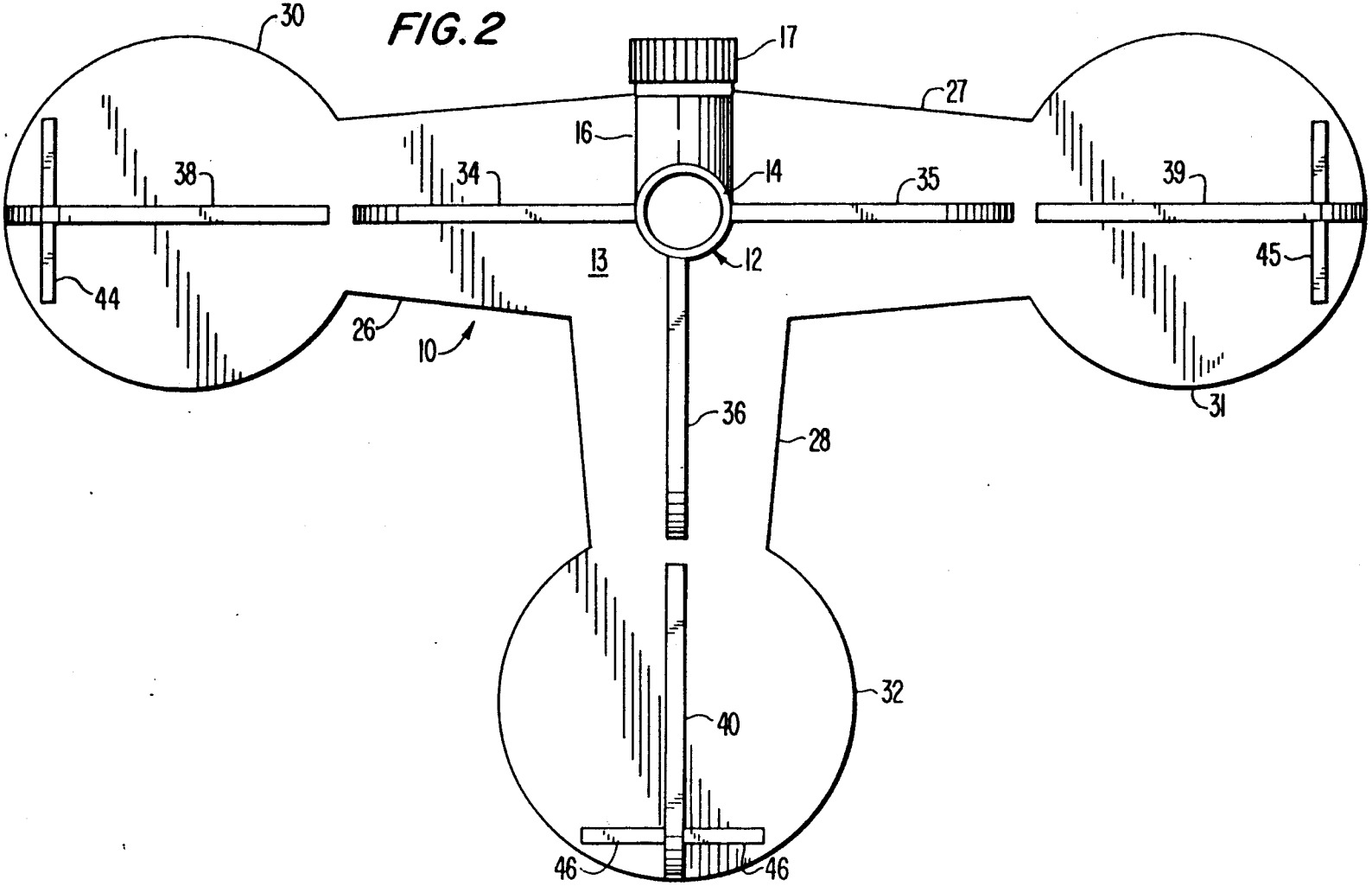
FIG. 2 is a top plan view of a sprinkler base in accordance with the invention.

A second set of braces, formed by pairs of triangular members 44, 45, and 46 serve to stabilize and support the hook members, keeping them in their upright positions. As will be recognized in FIG. 2, the hook members and the braces which support conduit 12 are flat members which lie in substantially the same planes, in pairs.

The sprinkler base thus described can be made of any hard material, preferably a hard, molded plastic material, preferably one which withstands the effects of sun and other weather conditions without rapid degradation.

In order to use the sprinkler base structure of the present invention, a sprinkler head is attached to opening 14 in conduit 12 and the male fitting of a garden hose is threaded into fitting 17 at the end of conduit 12. The hose is then coiled around the central portion of the sprinkler base with each coil of hose being pressed through the gaps, successively, between the upper ends of hooks 38–40 and the outer ends of brace members 34–36 until at least one and as many as three, coils of hose lie in the cavities under the hooks. The other end of the hose is then attached to a water supply, the sprinkler base is placed in the desired location, and water pressure is applied to the hose.

As water pressure is applied to the hose, the coils tend to expand and are restrained by the inwardly opening hooks, forming a secure connection between the hose and the sprinkler base. The weight of the hose stabilizes the sprinkler base against any action of the sprinkler itself which might tend to tip or tilt the base. Furthermore, if one wishes to relocate the sprinkler without turning off the water supply, it is simply necessary to grasp the hose at a distance from the sprinkling pattern and slide the sprinkler base across the lawn, the bottom surface thereof being completely flat and smooth and the corners being curved so as to not inhibit any such movement.

It will be recognized that the sprinkler base and sprinkler head can readily be formed as a single, integral unit. It will also be recognized that the specific shapes, and even the number, of radially extending arms can be altered. However, providing three arms as illustrated, forming a T-shaped arrangement with the hose fitting 17 extending in a fourth direction provides a particularly advantageous arrangement because there is sufficient space between the arms to receive coils of hose and hold them securely while leaving sufficient space on the fourth side for attachment to the hose itself.

While a particularly advantageous embodiment has been disclosed herein, it will be recognized by those skilled in the art that various modifications can be made therein without departing from the scope of the appended claims.

What is claimed is:

1. A base for a sprinkler head comprising a water conduit having a first end connectible to a sprinkler head and a second end connectible to a garden hose;

a substantially planar base plate having a central portion having means for supporting said water conduit, and a plurality of arm portions extending radially outwardly from said central portion, each of said arm portions having a distal end;

a plurality of hook members mounted on said distal ends of said arm portions, each of said hook members defining an inwardly facing cavity dimensioned to receive a portion of a garden hose, whereby a hose can be successively placed in said cavities of said hook members while being coiled around said water conduit on said base plate and attached to said second end of said conduit to supply water through said conduit to said sprinkler head while stabilizing said base.

2. A base according to claim 1 wherein said base plate includes two arm portions substantially aligned with each other on opposite sides of said conduit and a third arm portion generally perpendicular to said two arm portions, thereby forming a T-shaped configuration, and wherein said second end of said conduit extends radially outwardly substantially aligned with said third arm portion.

3. A base according to claim 2 wherein said conduit comprises an elbow member having female threaded fittings at both ends with axes separated by about 90 degrees.

4. A base according to claim 3 wherein said first end of said conduit is generally perpendicular to said base plate so that said first end opens upwardly when said base plate is horizontal and said means for supporting said conduit includes a plurality of brace members attached to said base plate and extending radially outwardly from said first end of said conduit in planes perpendicular to said base plate for supporting said first end in said perpendicular position.

5. A base according to claim 4 wherein each of said hook members comprises a generally L-shaped, flat body with one end of each body being attached to the upper surface of said base plate adjacent a distal end of one of said arm portions, and the other end of said body pointing toward the central axis of said first end of said water conduit.

6. A base according to claim 5 and further comprising a second plurality of brace members attached to said base plate and positioned in pairs on opposite sides of each of said hook members to support each said body.

7. A base according to claim 1 wherein said conduit comprises an elbow member having female threaded fittings at both ends with axes separated by about 90 degrees.

8. A base according to claim 7 wherein said first end of said conduit is generally perpendicular to said base plate so that said first end opens upwardly when said base plate is horizontal and said means for supporting said conduit includes a plurality of brace members attached to said base plate and extending radially outwardly from said first end of said conduit in planes perpendicular to said base plate for supporting said first end in said perpendicular position.

9. A base according to claim 8 wherein each of said hook members comprises a generally L-shaped, flat body with one end of each body being attached to the upper surface of said base plate adjacent a distal end of one of said arm portions, and the other end of said body pointing toward the central axis of said first end of said water conduit.

10. A base according to claim 1 wherein each of said hook members comprises a generally L-shaped, flat body with one end of each body being attached to the upper surface of said base plate adjacent a distal end of one of said arm portions, and the other end of said body pointing toward the central axis of said first end of said water conduit.

11. A base for a sprinkler head comprising a water conduit having a first end connectible to a sprinkler head and a second end connectible to a garden hose;

a substantially planar base plate having a central portion having means for supporting said water conduit with said first end of said conduit generally perpendicular to said base plate so that said first end opens upwardly when said base plate is horizontal, and a plurality of arm portions extending radially outwardly from said central portion, each of said arm portions having a distal end, said means for supporting said conduit including a plurality of brace members attached to said base plate and extending radially outwardly from said first end of said conduit in planes perpendicular to said base plate for supporting said first end in said perpendicular position;

a plurality of hook members mounted on said arm portions, each of said hook members defining an inwardly facing cavity dimensioned to receive a portion of a garden hose, each of said hook members comprising a generally L-shaped, flat body with one end of each body being attached to the upper surface of said base plate adjacent a distal end of one of said arm portions, and the other end of said body pointing toward the central axis of said first end of said water conduit, said other end of said body forming, with an upper edge of an adjacent brace member, a gap dimensioned to closely receive a garden hose inserted laterally, whereby a hose can be successively placed in said cavities of said hook members while being coiled around said water conduit on said base plate and attached to said second end of said conduit to supply water through said conduit to said sprinkler head while stabilizing said base.

12. A base according to claim 11 wherein the bottom of said base plate is substantially smooth and flat.

13. A base according to claim 12 wherein outwardly facing edges of said distal ends of said arm portions are smoothly curved.

* * * * *